US006464602B1

(12) United States Patent
Rottger

(10) Patent No.: US 6,464,602 B1
(45) Date of Patent: Oct. 15, 2002

(54) IMPACT-ACTIVATED INTERACTIVE TOY

(75) Inventor: Gary J. Rottger, Somers, NY (US)

(73) Assignee: Virtual Toy House LLC, North Bergen, NJ (US)

( * ) Notice: Subject to any disclaimer, the term of this patent is extended or adjusted under 35 U.S.C. 154(b) by 4 days.

(21) Appl. No.: 09/605,302

(22) Filed: Jun. 28, 2000

(51) Int. Cl.[7] ..... A63B 39/00

(52) U.S. Cl. ..... 473/571; 473/570; 463/9; 273/430; 273/460

(58) Field of Search ..... 463/1, 9, 35; 273/429, 273/430, 431, 432, 459, 460; 473/571, 570

(56) References Cited

U.S. PATENT DOCUMENTS 3,798,833 A * 3/1974 Campbell ..... 273/161
4,326,710 A 4/1982 Breslow et al. ..... 273/1 E
4,363,482 A 12/1982 Goldfarb ..... 273/1 GC
4,595,200 A * 6/1986 Shishido ..... 473/571
6,227,933 B1 * 5/2001 Michaund et al. ..... 446/462

FOREIGN PATENT DOCUMENTS

GB 2 213 069 8/1989
GB 2 277 037 10/1994

* cited by examiner

*Primary Examiner*—Jessica Harrison
(74) *Attorney, Agent, or Firm*—Norris, McLaughlin & Marcus

(57) ABSTRACT

A mobile object, such as a hollow ball containing an electronic circuitry system is proposed. The circuitry includes a speech processor and a controller, an integrated circuit for a speech recorder, an integrated circuit for an audio amplifier, a microphone and a power supply and an impact switch and push button switches. In response to impact, the circuitry generates a randomly chosen multiple choice questions. According to the answer chosen by the player, he/she presses a push button switch representing the answer. The electronic system then verifies whether the answer is correct or incorrect and generates a signal accordingly.

12 Claims, 3 Drawing Sheets

IMPACT-ACTIVATED INTERACTIVE TOY

BACKGROUND OF THE INVENTION

1. Field of the Invention

The present invention relates to an interactive toy or game which is impact-activated. More specifically, the present invention relates to a mobile object, for example, a throwable object, which after being thrown by one person, releases an audible question and at least three possible answers. The catcher then attempts to correctly answer the question and activates one of several buttons accessible on the outside of the object. Each button representing a choice of answer. Upon activating a any button, another audible sound is generated identifying whether the answer is correct or incorrect.

2. Description of the Related Art

Interactive toys or games enjoy an extreme popularity. Accordingly, a wide variety of interactive toys are available for entertaining adults and educating children. Since electronic integrated circuits allow sophisticated interactions and, for the most parts, are available in smallest sizes and formats, they are utilized by toy and game manufacturers to a high degree to create very sophisticated interactive toys and games. Many toys and games involve several players, but the same toy or game may also entertain and/or educate just a single user without becoming bored.

A number of prior art patents include interactive toy balls. For example, U.S. Pat. No. 5,445,375 discloses a ball toy and game method utilizing the ball device. The ball toy includes two hemispherical parts that may be separated to enclose an electronic timing device and a digitized voice module. The electronic timing device is actuated by pressing a button switch to initiate a randomly programmed timer. The randomly programmed timer will, at the end of the randomly programmed time interval actuated a voice module that will enunciate the word "gotcha", or any other programmed word.

U.S. Pat. No. 4,991,847 uses a ball shaped configuration that has an internal compartment in which a water filled balloon is enclosed. A spring driven motor drives an abrasive wheel or disk having a abrasive coating thereon. The spring driven motor turns the wheel such that the abrasive will rub against the water filled balloon, rupturing the balloon and releasing the water.

In U.S. Pat. No. 4,872,854, a ball shaped device has the appearance of a base ball. An electronic device is in the ball shaped device such as a radio and/or clock.

U.S. Pat. No. 5,375,839 discloses an impact sensitive talking ball which has a speaking unit mounted inside including an adapter which fits in an aperture in the ball to hold the unit in position. A plunger fits against an inside surface and operates a test switch when the ball is squeezed. The speaking unit is provided with a voice record chip, batteries and a vibration switch. When the ball is hit or bounced, a message broadcast is initiated by the vibration switch.

U.S. Pat. No. 5,883,569 discloses a mobile object with circuitry which transmits a signal upon impact of the object. The signal is received by a receiver which generates a sound in accordance with the signal. The occurrence of an impact can be detected by the contacting of conductive layers caused by the temporary deformation of the object or acoustically.

There are also a variety of interactive talking toys, such as disclosed in U.S. Pat. Nos. 5,288,069 and 4,923,428. In addition, there are electronic educational games in which responses are provided, such as, for example, U.S. Pat. Nos. 5,413, 355, 3,711,964 and 4,049,265.

However, none of these toys or games utilize a multiple choice quiz environment in which the player hears a randomly chosen question upon impact of a ball and is challenged to provide a correct answer, which is instantaneously verified for correctness of the answer.

It is therefore desirable to propose an impact-activated interactive toy or game which may capture the interest of adults as well as children and which entertains both adults and children.

SUMMARY OF THE INVENTION

The present invention is directed to a mobile object, preferable a ball of any shape which is thrown by a player into the air or against a wall or the floor and caught by the player. The ball may also be thrown to a second player who acts as a catcher. The ball may also be thrown amongst several players. The outside material of the ball is contemplated to be of made of any material suitable for easy catching, such as textured material. The size may also vary, depending on the tactile capabilities of the players. For smaller children, the ball is contemplated to be manufactured in a smaller size made of a softer poly foam surface material; for more mature players, the ball may be larger and the outer surface of the ball may be manufactured of harder rubberized material.

The outer shell of the ball encloses a cavity, which contains electrical and electronic components to operate the ball. For example, the ball may be assembled from two hemispherical portions made of a hard plastic that provide the housing for the electrical electronic components and the power supply. The two hemispherical half shells may be snap locked to each other to form a ball or they may include a male or female thread for fitting them together. Because the power source has to be exchanged from time to time, a mechanism that easily disengages and re-engages the two halves is suitable. Also, at least three switches or push buttons, adapted to be touched or pushed in from the outside, need to be accessible from the outside of the ball.

Thus, upon the ball being either caught by another player or being bounced off a wall or a floor, an impact switch is activated which starts the game by causing a speech processor and controller to generate a question with at least three choices of different answers. The player chooses one of the answers which is identified, for example, as A, B or C. The player pressed one of the three switches, which in his or her view represents the correct answer. For that purpose, the switches are marked A, B and C on the outside of the ball. If the correct switch is pushed, the circuitry provides another response, which indicates whether the answer is correct or incorrect. Is the answer incorrect, the circuitry provides for a second chance of pushing the correct button to identify the correct answer. Thus, upon closing one of the A, B or C switches in response to the first audible signal, the electronic circuitry provides a second audible signal. Further, the electronic circuitry generates a third audible signal in response to the second audible signal. To make the game more challenging, the response time may be timed, that is, the player has to press one of the A,B or C switches within a certain time period. Then, the ball may be thrown to the next player and the game starts from the beginning.

There is an indefinite number of possibilities of subject matter categories of questions that can be provided. The subject matters may be from areas of sports trivia, music, history, entertainment, politics or general trivia, etc. The impact-activated interactive toy can be designed to be entertaining as well as educational. Thus, the questions may also be geared towards school children of any are, and may include category like mathematics, spelling, geography, vocabulary of any foreign language, and alike. The categories may be school grade or age specific.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the drawings, wherein like reference numerals delineate similar elements throughout the several views.

DETAILED DESCRIPTION OF THE PRESENTLY PREFERRED EMBODIMENTS

Figure 1:
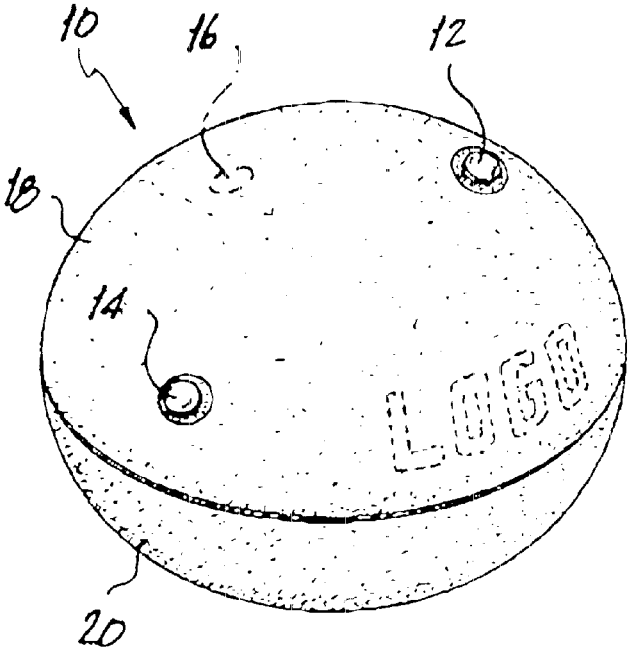
FIG. 1 illustrates the outside view of the ball according to one embodiment of the present inventions.
Figure 2:
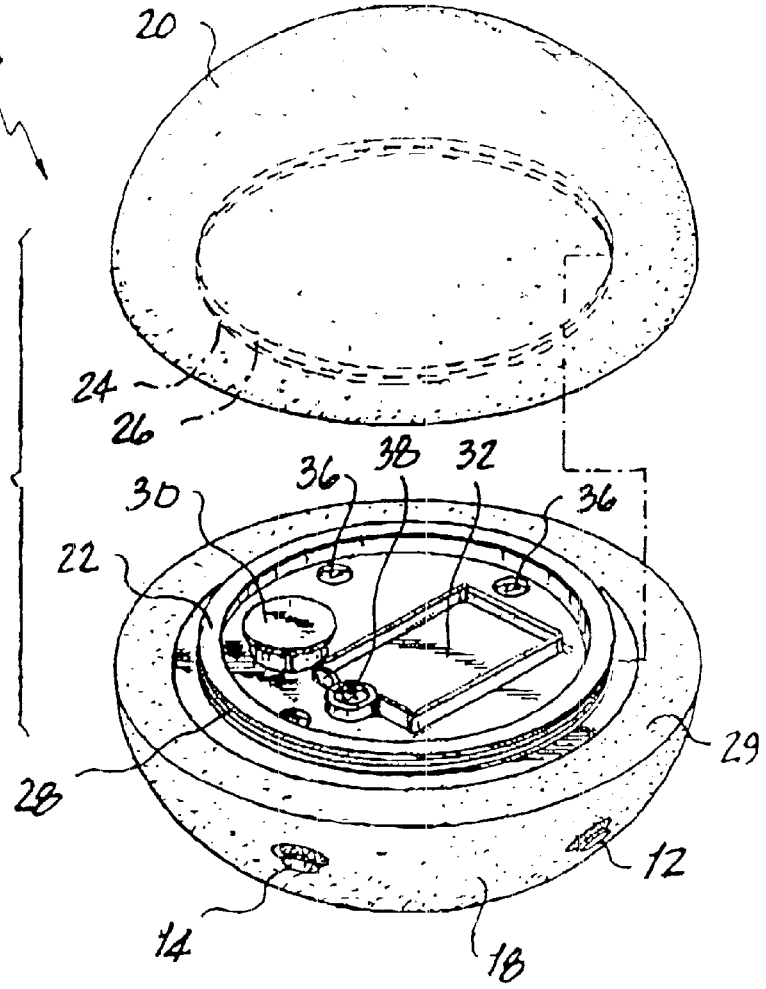
FIG. 2 illustrates an exploded view of the ball according to one embodiment of the invention.
Figure 2A:
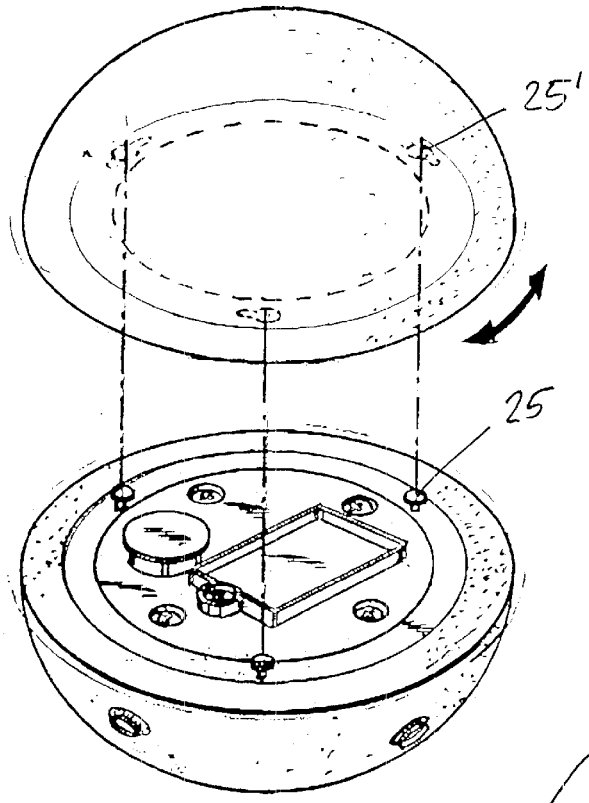
FIG. 2A also illustrates an exploded view of the ball according to a second embodiment.
Figure 2B:
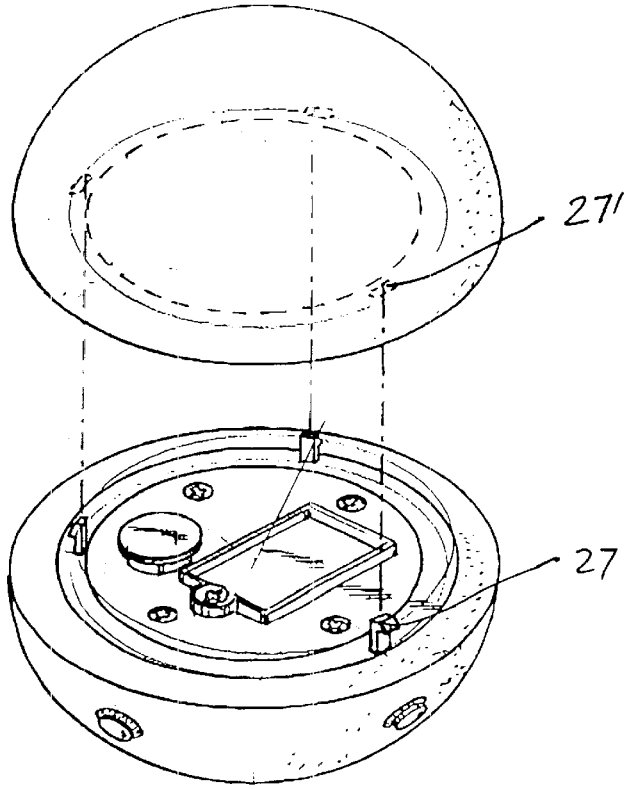
FIG. 2B also illustrates an exploded view of the ball according to a third embodiment.

Referring now more particularly to FIGS. 1 and 2 of the drawings, an impact-activated interactive ball 10 constructed according to the invention is there presented. In this embodiment of the invention, each of the half shells include a rim 22 and 24 which are formed with a male and female thread 26 and 28 to connect the two hemispherical half shells 18 and 20 to the ball 10. The two half shells may also be connected to each other by a bayonet-type closings, as shown in FIG. 2A and indicated by numeral 25 and 25' or snap-type closings as shown in FIG. 2B and indicated by numeral 27 and 27'. The material of the half shells is a harder plastic or similarly suited material. The outside of the half shells is covered with a textured or rubberized material, for example, a poly foam material for easy gripping and handling. The hemispherical half shell 18, shown in FIG. 2, contains electric components, that is, push button switches 12, 14, 16 and impact switch 30 as well as the electronic circuitry system 34 and a power source, such as a battery or batteries 46. The batteries 46 are located behind battery lid and may be replaced by disassembling the two half shells 18 and 20 and by opening screw 38 to lift the battery lid 32 which gives access to conventional batteries. The electronic circuitry system 34, including the impact switch 30 is mounted into one shell half with mounting screws 36. Three switches 12, 14 and 16 are mounted into the same half shell that accommodated the electronic circuitry. These three switches are accessible for pushing from the outside of the ball. They are mounted such that they are recessed so that the overall handling of the ball is not impeded. Internally, the three switches are connected to the electronic circuitry system, as will be shown on the circuit diagram shown in FIG. 3.

Figure 3:
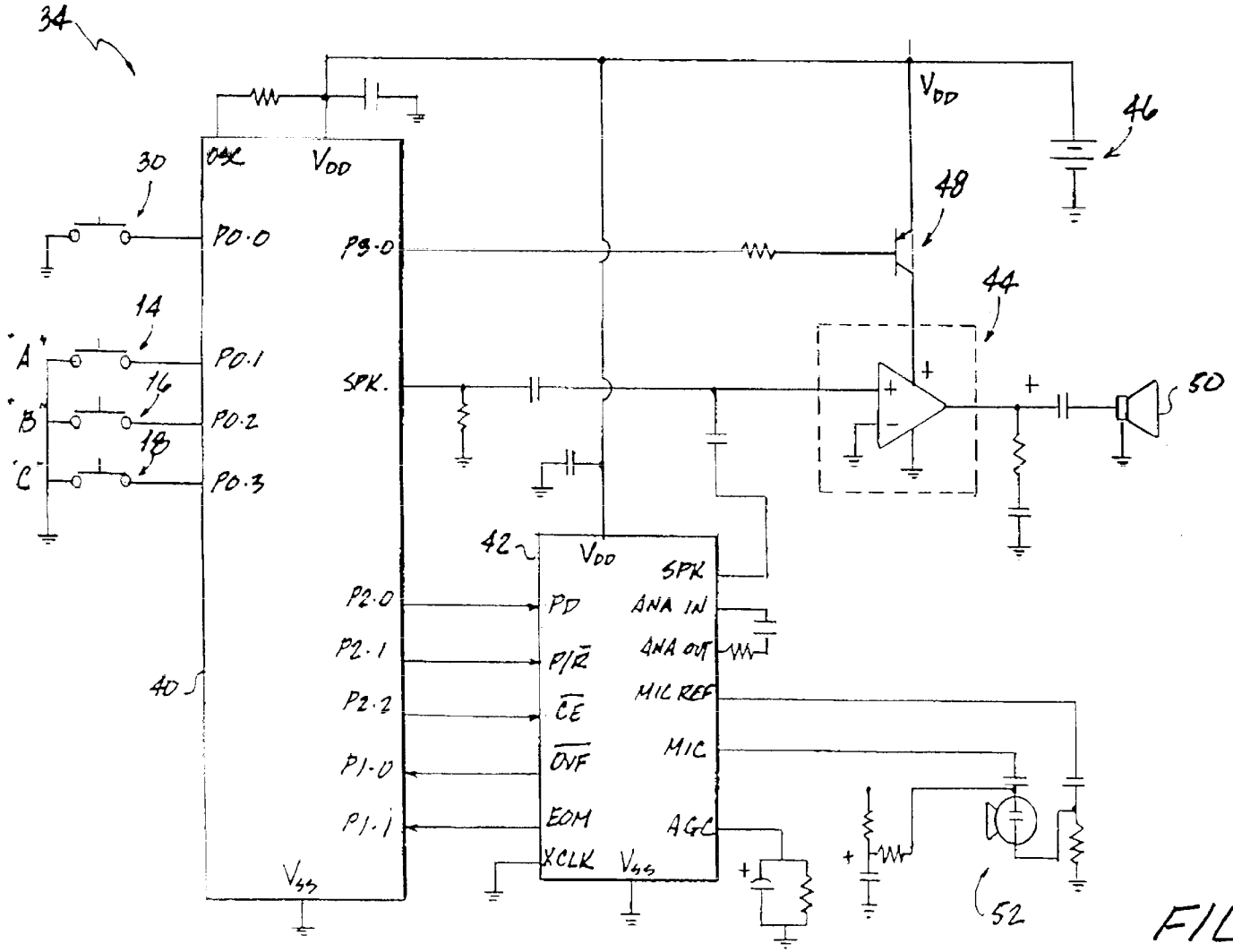
FIG. 3 illustrates a circuit diagram of another embodiment of the invention.

In FIG. 3, the electric and electronic circuit diagram is shown. Numeral 30 represents the impact switch 30; numerals 14, 16 and 18 represent the switches A, B and C, which can be activated from the outside of the ball. The electronic circuitry 34 includes an integrated circuit for a speech processor and a controller 40, an integrated circuit for a speech recorder 42, an integrated circuit for an audio amplifier 44. The integrated circuit for an audio amplifier 44 amplifies both the speech processor and a controller 40 and the speech recorder 42. The audio amplifier is connected to a speaker 50. The electronic circuitry system is powered by batteries 46. The microphone 52 is connected to the speech recorder 42. For saving battery power, a transistor 48 is utilized to save power when no acoustical signal is present so that the audio amplifier is turned off.

The operation of the impacting activated interactive ball 10 is as follows: upon throwing the ball 10 against a wall, floor or to another player, the impact switch 30 is activated and the electronic circuitry system 34 provides an audible randomly generated question and, for example, three choices of answers, answer A, answer B or answer C. According to the player's choice of answer, he or she may push switch 12, representing answer A, or switch 14, representing answer B or switch 16, representing answer C. Connecting either push button switches A, B or C to the speech processor and controller 40 of the electronic circuitry system 34 initiates the system to audibly respond by stating whether the answer is correct or incorrect, for example, "Yes, B is the correct answer". The audible response may be by enunciation of a word or words or by a certain type of musical signal. The same is the case in the event the answer is incorrect. The player may push one of the two remaining switches for getting the answer correct, for example "No, C is incorrect, try again". To add a challenge to the game, the circuitry may also include a timer so that the player is forces to choose a "correct" button for the response within a given period of time, or the player loses his turn. The programmed questions and answers may represent any subject area and obviously, may attract any age group, from small children who just learn or realize concepts, such as "What color is the tree? Is it A, green; B, white; or C, yellow." For sports enthusiasts, the game version may be directed at sport trivia. The present application is not directed at any particular subject matter.

The electronic circuitry of the preferred embodiment comprises integrated circuits that are each known and commercially available. The speech processor and controller is a WINBOND W56ZM or an equivalent circuitry. The speech processor 40 controls the speech recorder 42, which is a ISD2500; and the audio amplifier 44 for the circuits 40 and 42 is a LM386. The transistor 48, which controls the power supply for the audio amplifier and turns off the power when the sounds are off, is a transistor, known as a 9012. Components having equivalent characteristics may also be combined to provide for the same function as is characteristic of the circuits identified above.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A mobile object comprising:

a ball including two engageable half shells;

an electronic circuitry system including an integrated circuit for a speech processor and a controller, an integrated circuit for a speech recorder, an integrated circuit for an audio amplifier, a microphone and a power supply;

an impact switch connected to the electronic circuitry system;

at least three switches connected parallel to the speech processor and the controller;

the electronic circuitry system being disposed inside the hollow ball;

the impact switch being arranged in the body such as to detect an impact involving the mobile object and generating a first audible signal in response to an impact in the electronic circuitry;

the at least three switches being accessible from the outside of the ball, one of the at least three switches being associated with the first audible signal;

upon closing one of the at least three switches in response to the first audible signal, the electronic circuitry provides a second audible signal based on the first audible signal and the closing of one of the at least three switches; and the electronic circuitry generates a third audible signal when the closed one of the at least three switches is not associated with the first audible signal, the third audible signal being based on the first audible signal and the closing of another of the at least three switches.

2. The mobile object according to claim 1, wherein the first audible signal is in form of a randomly selected question and at least three answer choices.

3. The mobile object according to claim 2, wherein the at least three switches represent at least one correct and two incorrect answer choices.

4. The mobile object according to claim 3, wherein the third audible signal represent a correct or incorrect answer.

5. The mobile object according to claim 1, wherein in the integrated circuit for speech processor and controller is known as Winbond W562M02.

6. The mobile object according to claim 5, wherein the integrated circuit for the speech recorder is known as an ISD25600.

7. The mobile object according to claim 6, wherein the integrated circuit for the audio amplifier is known as a LM 386.

8. The mobile object according to claim 1, wherein the electronic circuitry system comprises a transistor for controlling the power supply such that when no audible signal is transmitted from the audio amplifier, the power supply is turned off.

9. The mobile object according to claim 1, wherein the first of the two engageable half shells comprises a first rim formed with a male thread and wherein the second of the two engagable half shells comprises a second rim formed with a female thread.

10. The mobile object according to claim 1, wherein the first of the two half shells engage by snap locks into the second half shell.

11. The mobile object according to claim 1, wherein the two half shells are covered with textured material.

12. The mobile object according to claim 1, wherein the two half shells are covered with poly foam material.

* * * * *